US006024594A

United States Patent [19]

Self, Jr. et al.

[11] Patent Number: 6,024,594

[45] Date of Patent: Feb. 15, 2000

[54] CONNECTOR LATCH WITH TUBULAR HINGE

[75] Inventors: Daines Milfred Self, Jr., Oak Ridge; Roy Kenneth Whitaker, Jr., Kernersville, both of N.C.

[73] Assignee: The Whitaker Corporation, Wilmington, Del.

[21] Appl. No.: 09/006,091

[22] Filed: Jan. 13, 1998

[51] Int. Cl.[7] ..... H01R 13/627

[52] U.S. Cl. ..... 439/358; 439/552

[58] Field of Search ..... 439/544, 545, 439/547, 549, 552–3, 557, 562, 357, 358, 325, 328, 342

[56] References Cited

U.S. PATENT DOCUMENTS

| | | | |
|---|---|---|---|
| 4,944,693 | 7/1990 | Puerner | 439/358 |
| 5,127,847 | 7/1992 | Kato et al. | 439/357 |
| 5,254,014 | 10/1993 | Yagi et al. | 439/353 |
| 5,340,329 | 8/1994 | Hirai | 439/357 |
| 5,382,177 | 1/1995 | Hutchinson, Jr. et al. | 439/358 |
| 5,692,681 | 12/1997 | Steinhauser et al. | 439/677 |
| 5,720,629 | 2/1998 | Self, Jr. et al. | 439/587 |

*Primary Examiner*—Lincoln Donovan

[57] ABSTRACT

An electrical connector includes a dielectric housing having a latch arm which is connected to the housing by a tubular hinge that is integrally molded with the housing and with the latch arm. The latch arm extends from the housing in a forward direction, and an axis of the tubular hinge extends transverse to the forward direction. A locking arm is connected to the latch arm and is cooperable with the housing to exert tension on the latch arm when the latch arm is engaged with a mating electrical connector. The locking arm has a hook portion that engages an inclined surface of the housing to facilitate tensioning of the latch arm.

6 Claims, 3 Drawing Sheets

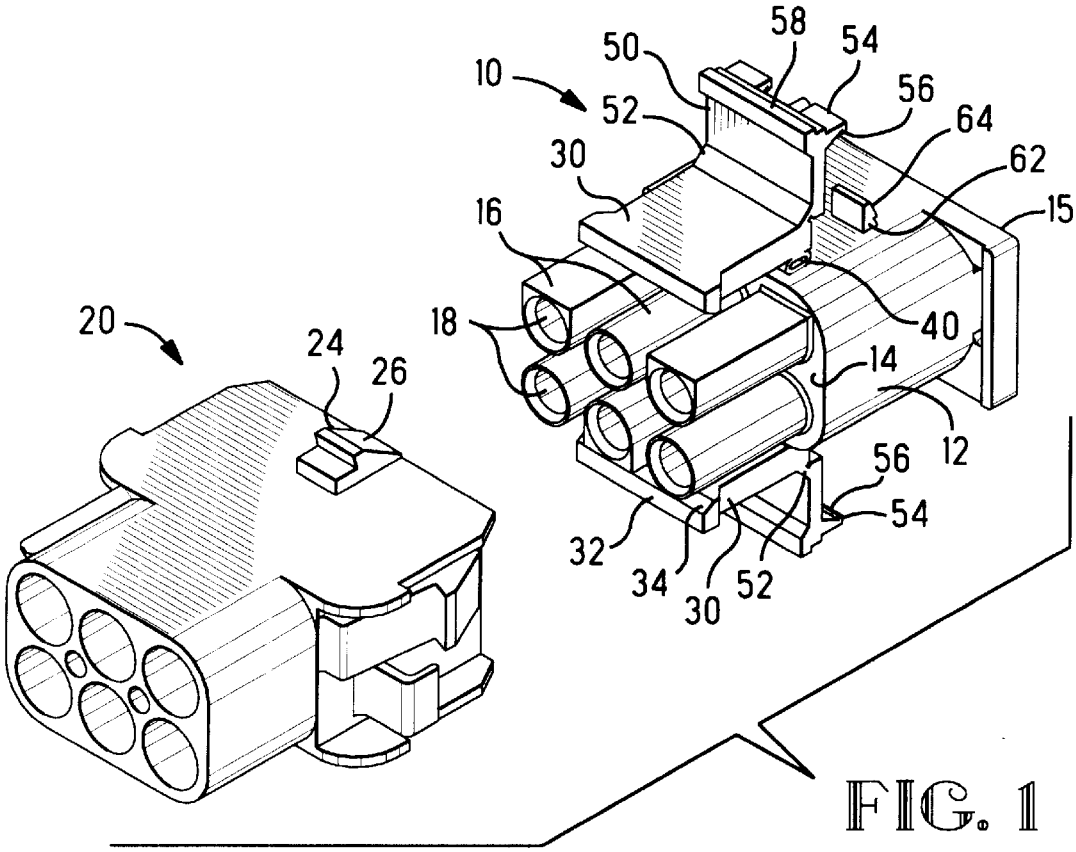
FIG. 1
FIG. 2
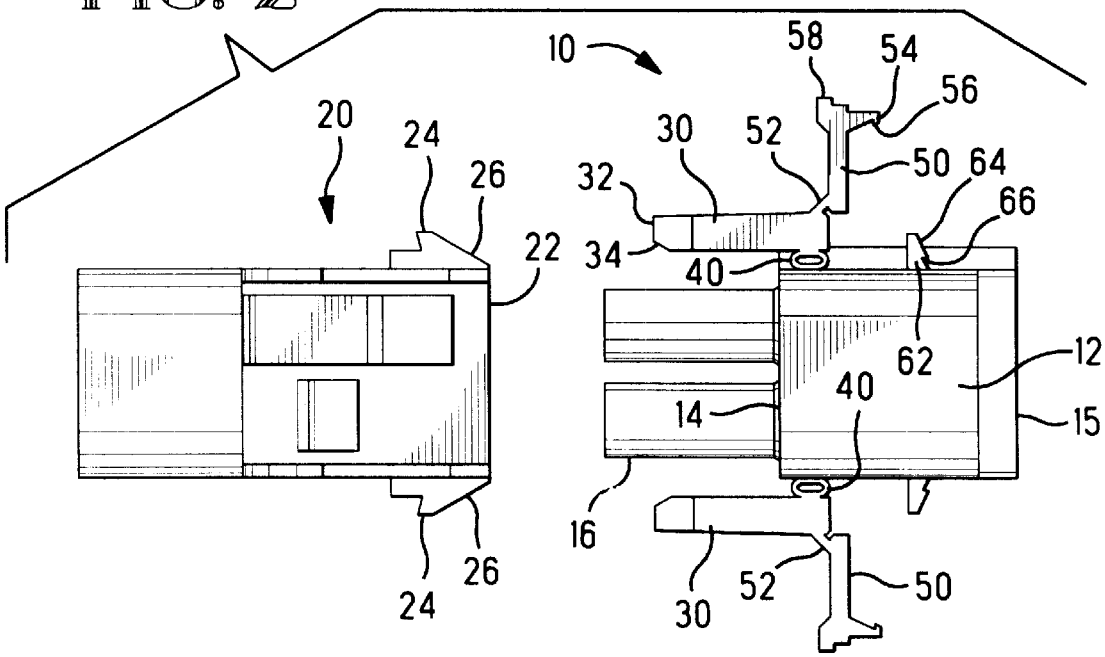

CONNECTOR LATCH WITH TUBULAR HINGE

FIELD OF THE INVENTION

The invention relates to an electrical connector having a hinged latch for locking the connector to a mating connector.

BACKGROUND OF THE INVENTION

U.S. patent application Ser. No. 08/733,059 now U.S. Pat. No. 5,720,629, discloses a sealed electrical connector assembly including mating electrical connectors having an interfacial seal disposed between mating faces of the connectors. One of the connectors has latches which cooperate with the other connector to secure the connectors in a mated condition. The connectors may be used either with or without the interfacial seal. The interfacial seal must be compressed with significant force between the mated connectors, and it is difficult to latch the connectors together when the interfacial seal is being used. A hand tool is often used to assist in latching the connectors together when using the seal. There is a need to facilitate latching together of mating electrical connectors when an interfacial seal is used between the connectors.

SUMMARY OF THE INVENTION

The invention is an electrical connector comprising a dielectric housing having a latch arm which is connected to the housing by a tubular hinge that is integrally molded with the housing and with the latch arm.

According to one aspect of the invention, the tubular hinge includes forward and rearward spaced-apart bights. The latch arm extends from the housing in a forward direction, and an axis of the tubular hinge extends transverse to the forward direction.

According to another aspect of the invention, a locking arm is connected to the latch arm and is cooperable with the housing to exert tension on the latch arm when the latch arm is engaged with a mating electrical connector.

According to yet another aspect of the invention, the locking arm has a hook portion that engages an inclined surface of the housing to facilitate tensioning of the latch arm.

BRIEF DESCRIPTION OF THE DRAWINGS

The invention will now be described by way of example with reference to the accompanying drawings wherein:

FIG. 1 is an isometric view of an electrical connector according to the invention, along with a mating electrical connector;

FIG. 2 is a side view of the connectors;

DETAILED DESCRIPTION OF A PREFERRED EMBODIMENT

Figure 3:
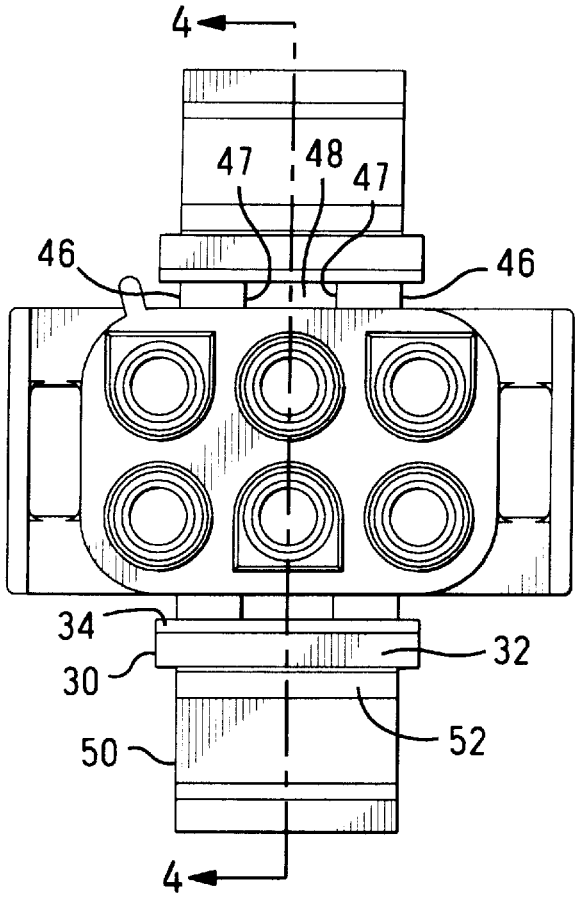
FIG. 3 is a front view of the connector according to the invention.

There is shown in FIGS. 1 and 2 an electrical connector 10 according to the invention, along with a mating connector 20. The connector 10 is shown as a plug connector, and the connector 20 is a corresponding socket connector. However, it should be understood that the invention can be incorporated in numerous different types of matable electrical connectors, and all such connectors are considered to be within the scope of the invention.

The connector 10 comprises a dielectric housing 12 having a forward mating face 14 and a rearward terminating face 15. The housing 12 has a plurality of silos 16 that extend forwardly from the mating face. Contact receiving cavities 18 extend longitudinally through the connector from the terminating face 15 through the silos 16. The housing 12 can hold a plurality of contact pins (not shown) with mating ends of the contact pins disposed in the silos. The silos 16 are receivable in cavities of the mating connector 20 so that the contact pins in the silos will electrically engage socket contacts in the cavities of the mating connector.

An interfacial seal (not shown) may be sandwiched between the forward mating face 14 of the housing 12 and a corresponding mating face 22 of the mating connector 20. Details of such an interfacial seal are disclosed in U.S. patent application Ser. No. 08/733,059 now U.S. Pat. No. 5,720,629, which is incorporated by reference as if set forth fully herein.

The connector 10 has a pair of deflectable latch arms 30 attached to respective opposite sides of the housing 12. The latch arms 30 are cooperable with latch tabs 24 on the mating connector to secure the connectors together in a mated condition. In an undeflected state the latch arms 30 are poised to engage the latch tabs 24 as the connectors are brought together. Each of the latch arms 30 has a forward end 32 with a beveled surface 34 which engages a ramp surface 26 of its corresponding latch tab 24, thereby causing the latch arms 30 to deflect during mating of the connectors. Each of the latch arms 30 has a rearwardly facing ledge 36 (FIG. 4) that drops behind its corresponding latch tab 24 when the ledge passes beyond the latch tab, whereby the latch arms capture the latch tabs so that the connectors are locked together.

Figure 4:
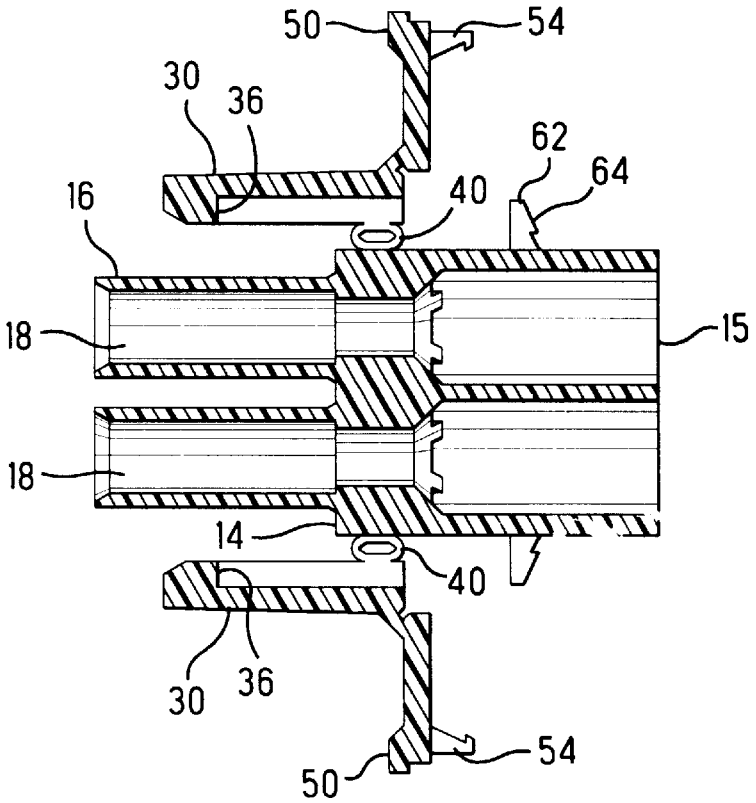
FIG. 4 is a cross-sectional view taken along line 4–4 in FIG. 3.
Figure 5:
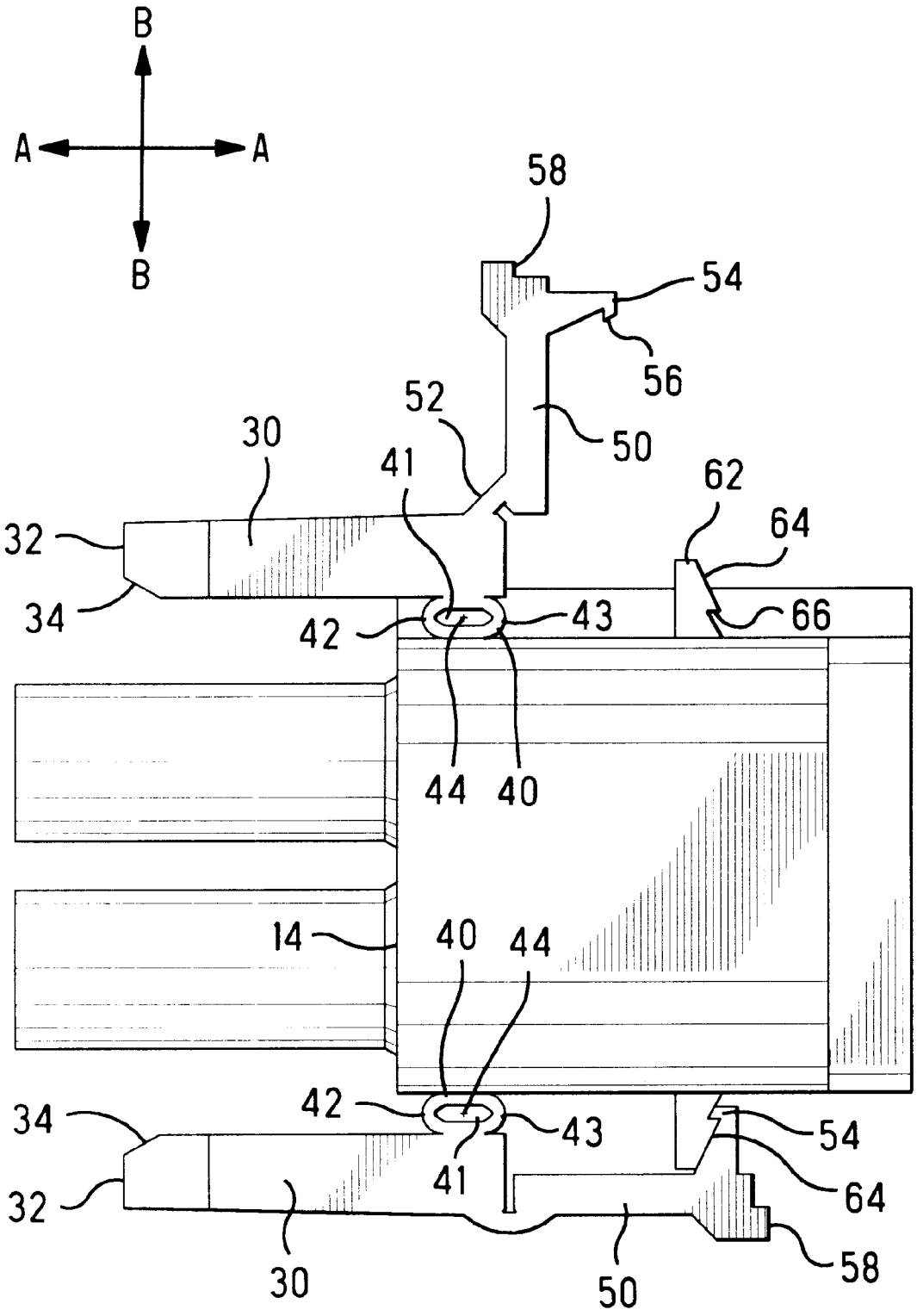
FIG. 5 is an enlarged side view of the connector according to the invention.

With reference also to FIGS. 3–5, each of the latch arms 30 is connected to the housing 12 by a tubular hinge 40 which permits its latch arm 30 to pivot a limited amount so that the latch arms 30 can override the latch tabs 24 during mating and unmating of the connectors. The tubular hinges 40 are integrally molded with the housing 12 and with the latch arms 30 to provide a unitary one-piece structure. As best seen in FIG. 5, each of the tubular hinges 40 has an interior cavity 41 between spaced-apart forward and rearward bights 42, 43. Each of the tubular hinges 40 defines a hinge axis 44 which extends transverse to the forwardly extending latch arm 30. The forward and rearward bights 42, 43 of the tubular hinge are torsionally flexible so that the tubular hinge can be twisted on the axis 44 and/or stretched in horizontal direction A—A and vertical direction B—B. This deformability of the tubular hinge enables the latch arm 30 to be moved a limited amount in both directions A—A and B—B, as well as to pivot a limited amount on the hinge axis 44. This available range of movement enables the latch arms 30 to capture their corresponding latch tabs 24 relatively easily even when an interfacial seal is disposed between the mating connectors.

As shown in FIG. 5, the tubular hinge 40 has an oval cross-section and each of the bights 42, 43 has an arcuate cross-sectional shape. The tubular hinge may be constructed with some other cross-sectional shape such as circular or square.

With reference to FIG. 3, the tubular hinge may extend continuously between opposite lateral ends 46, or the tubular hinge may be configured with tubular hinge portions 47 which are aligned on the axis 44 (FIG. 5) and are separated by one or more gaps 48.

Lock arms 50 are connected to the latch arms 30 by flexible hinges 52 which permit pivoting of each lock arm through an angle between an unlock position as shown by the upper lock arm in FIG. 5, and a lock position as shown by the lower lock arm in FIG. 5. Each of the lock arms has a hook portion 54 which is engageable with a corresponding projection 62 on the housing 12. The hook portion 54 has a ramp surface 56 which cooperates with a complementary rearwardly facing ramp surface 64 on the projection 62. When the ledge 36 of the latch arm 30 is in position beyond the latch tab 24 on the mating connector 20 and the lock arm 50 is moved to the lock position, the ramps 56 and 64 cooperate to exert tension on the lock arm 50 and the latch arm 30. The lock arm 50 is secured in the lock position when the hook portion 54 becomes lodged in a recess 66 below the ramp 64 of the projection. The lock arm has a finger grip portion 58 which can be urged outwardly from the connector to withdraw the hook portion 54 from the recess 66, thereby releasing tension from the latch arm 30 so that the latch arm can be deflected to permit decoupling of the connectors 10 and 20.

The invention provides a hinge for an electrical connector latch arm which increases the range of motion of the latch arm. The hinge has resiliency and compliancy which promotes easy operation of the latch arm. The hinge enables tool-free operation of the latch arm when a compressible seal is used between mating electrical connectors.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. An electrical connector comprising:

a dielectric housing with a latch arm and a tubular hinge that is integrally molded with the housing and with the latch arm, the latch arm being cantilevered from the tubular hinge and extending to a free end, wherein a locking arm is cooperable with the housing to exert tension on the latch arm when the latch arm is engaged with a mating electrical connector.

2. The electrical connector of claim 1, wherein the locking arm is pivotally coupled to the latch arm.

3. The electrical connector of claim 2, wherein the locking arm has a hook portion that engages an inclined surface of the housing.

4. An electrical connector comprising:

a dielectric housing which is integrally molded with a latch arm and with forward and rearward spaced-apart bights, the latch arm being cantilevered from the forward and rearward spaced-apart bights and extending in a forward direction to a free end, wherein a locking arm is cooperable with the housing to exert tension on the latch arm when the latch arm is engaged with a mating electrical connector.

5. The electrical connector of claim 4, wherein the locking arm is pivotally coupled to the latch arm.

6. The electrical connector of claim 5, wherein the locking arm has a hook portion that engages an inclined surface of the housing.

* * * * *